United States Patent [19]

Berger

[11] 4,292,696

[45] Oct. 6, 1981

[54] SWIMMER ARRIVAL SIGNAL PANELS INCORPORATED IN A SWIMMING POOL BULKHEAD

[75] Inventor: Gordon Berger, Quebec, Canada

[73] Assignee: Annesberg Associates N.V., Curacao, Netherlands Antilles

[21] Appl. No.: 71,370

[22] Filed: Aug. 30, 1979

[51] Int. Cl.[3] ..... F04H 3/16; F04H 3/18

[52] U.S. Cl. ..... 4/505; 4/496; 272/1 B; 200/52 R

[58] Field of Search ..... 4/496, 497, 505, 488, 4/504; 272/71, 4, 26, 1 B; 200/52 R

[56] References Cited

U.S. PATENT DOCUMENTS

| | | | |
|---|---|---|---|
| 3,436,504 | 4/1969 | Gatsonides | 272/4 |
| 3,584,169 | 6/1971 | Leu | 272/4 |
| 3,590,181 | 6/1971 | Baran | 272/4 |
| 3,676,696 | 7/1972 | Leu et al. | 272/4 |
| 3,962,735 | 6/1976 | Davidson | 4/505 |
| 4,117,283 | 9/1978 | Hurzeller et al. | 200/52 R |
| 4,206,521 | 6/1980 | Davidson | 4/505 |

FOREIGN PATENT DOCUMENTS

| | | | |
|---|---|---|---|
| 572250 | 10/1974 | Switzerland | 272/4 |

*Primary Examiner*—John W. Shepperd
*Attorney, Agent, or Firm*—Larson and Taylor

[57] ABSTRACT

A swimming pool bulkhead is disclosed having a vertical surface on one or both sides which may be used as swimmer arrival signal devices. The bulkhead has swimmer arrival signal panels in all swimming lanes on at least one vertical side face and comprises a rigid structure having top members and bottom members extending lengthwise along the bulkhead, a walkway supported on the top members, the bulkhead vertical side face divided into substantially equal portions establishing individual swimming lanes. Roller support means are provided at each end of the bulkhead and removable locating and anchoring means at each end of the bulkhead. At least one swimmer arrival signal panel is provided within each of the portions representing individual swimming lanes, the panel extending between the top member and the bottom member on at least one side of the bulkhead, the panel having a switch means adapted to be activated when the panel is contacted by a swimmer.

11 Claims, 6 Drawing Figures

SWIMMER ARRIVAL SIGNAL PANELS INCORPORATED IN A SWIMMING POOL BULKHEAD

This invention relates to swimming pools. More particularly this invention defines a movable bulkhead for use in swimming pools wherein the vertical surface on one or both sides of the bulkhead may be used as swimmer arrival signal devices.

More new community and institutional swimming pools being constructed today are considerably larger than those built in the past. This is primarily because a pool has to perform several functions substantially at the same time. Such functions or activities include competitive swimming, recreational swimming, diving, water polo, life saving instructions, synchronized swimming practice, scuba diving, etc. In order to accomplish this, large pools are divided into a series of areas so that more than one activity can be carried on without interferring with adjacent pool areas. In these larger pools, bulkheads are used to separate these different areas. Bulkheads extend across the width of the pool and are movable along the length of the pool so that the different areas can be varied in size in accordance with the particular activity to be performed in each area. Initially, one bulkhead was considered sufficient for one pool. Now, however, with longer pools, several bulkheads may be required. When the pool area between bulkheads or between one bulkhead and the end of the pool is to be used for competitive swimming, the pool is divided into equal width swimming lanes using race lane floats which extend from one bulkhead to another or from one bulkhead to the end of the pool. Furthermore, a bulkhead may be equipped with starting platforms for the start of races. A similar arrangement is required for training purposes.

In competitive swimming, electronic timing systems are used to time swimmers in their individual swimming lanes. The timing systems preferably require a touch pad which is a separate pad mounted on one or sometimes on both ends of an individual swimming lane, either on the swimming pool end wall or alternatively just in front of the vertical surfaces of the bulkhead. Present practice is to remove these touch pads and connecting wire cables from the pool when the swimming competition is over and store them, otherwise the touch pads can become damaged during other aquatic activities because of their delicate construction. There is thus considerable time that must be spent in both preparing a swimming pool for competitive swimming races and then removing the switch pads and connecting cables when the meet is over.

Some bulkheads are designed to absorb both vertical and horizontal shock loading with negligible deflection. They usually have a rectangular cross section with vertical surfaces on each side extending down below the surface of the water so that the bulkhead becomes a solid partition or divider between different areas in the swimming pool. The vertical surfaces are sometimes perforated for ease of moving the bulkhead through the water and also to reduce the wave bounce back, or back pressures which a solid or unperforated surface of a bulkhead creates and which may adversely affect a swimmer's time in a race.

It is the purpose of the present invention to provide a bulkhead for a swimming pool having vertical surface panels, which act not only as a partition or divider in the swimming pool but also incorporate a number of switch means that are activated by swimmers contacting the panels. The bulkhead of the present device eliminates having to install and remove touch pads every time a pool is to be used for competitive swimming races or training. The present bulkhead provides swimmer arrival signal panels which constantly remain in the swimming pool and are integral with the bulkhead. The switch means cannot be damaged by normal aquatic activities that occur in a swimming pool.

The present invention provides a swimming pool bulkhead having swimmer arrival signal panels in all swimming lanes on at least one vertical side face, comprising a rigid structure having top members and bottom members extending lengthwise along the bulkhead, a walkway supported on the top members. The bulkhead vertical sideface divided into substantially equal portions establishing individual swimming lanes, roller support means at each end of the bulkhead, removable locating and anchoring means at each end of the bulkhead, at least one swimmer arrival signal panel within each of the portions representing individual swimming lanes, the panel extending between the top member and the bottom member on at least one side of the bulkhead, the panel having a switch means adapted to be activated when the panel is contacted by a swimmer.

In drawings which illustrate the embodiments of the invention,

Figure 1:
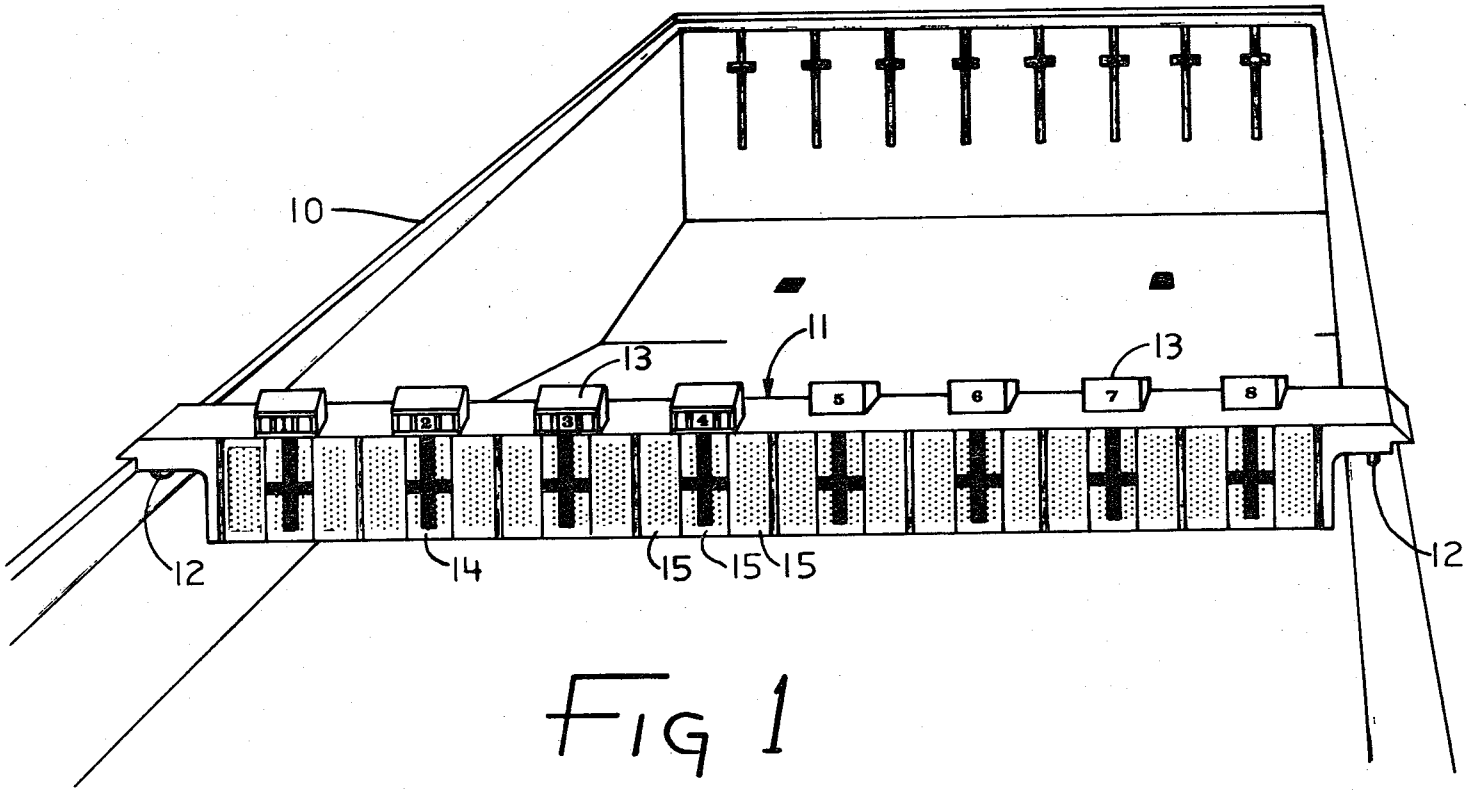
FIG. 1 is a perspective view showing one embodiment of a bulkhead in a swimming pool.

A swimming pool 10 is shown in FIG. 1 with a bulkhead 11 extending across the width of the swimming pool 10. The bulkhead 11 has support rollers 12 at either end to permit the bulkhead 11 to be moved up and down the length of the pool. The bulkhead 11 is divided into eight swimming lanes each having individual starting platforms 13. Four starting platforms 13 are shown facing in one direction, and four are facing in the opposite direction. The starting platforms 13 are reversible so that races can be started from either side of the bulkhead 11. The crosses 14 on the end wall of the swimming pool 10 and on the vertical surfaces of the bulkhead 11 represent the centre of each individual swimming lane. Three swimmer arrival signal panels 15 are provided on the vertical side of the bulkhead 11 in each swimming lane. These panels 15 extend from the top to the bottom of the bulkhead.

Figure 2:
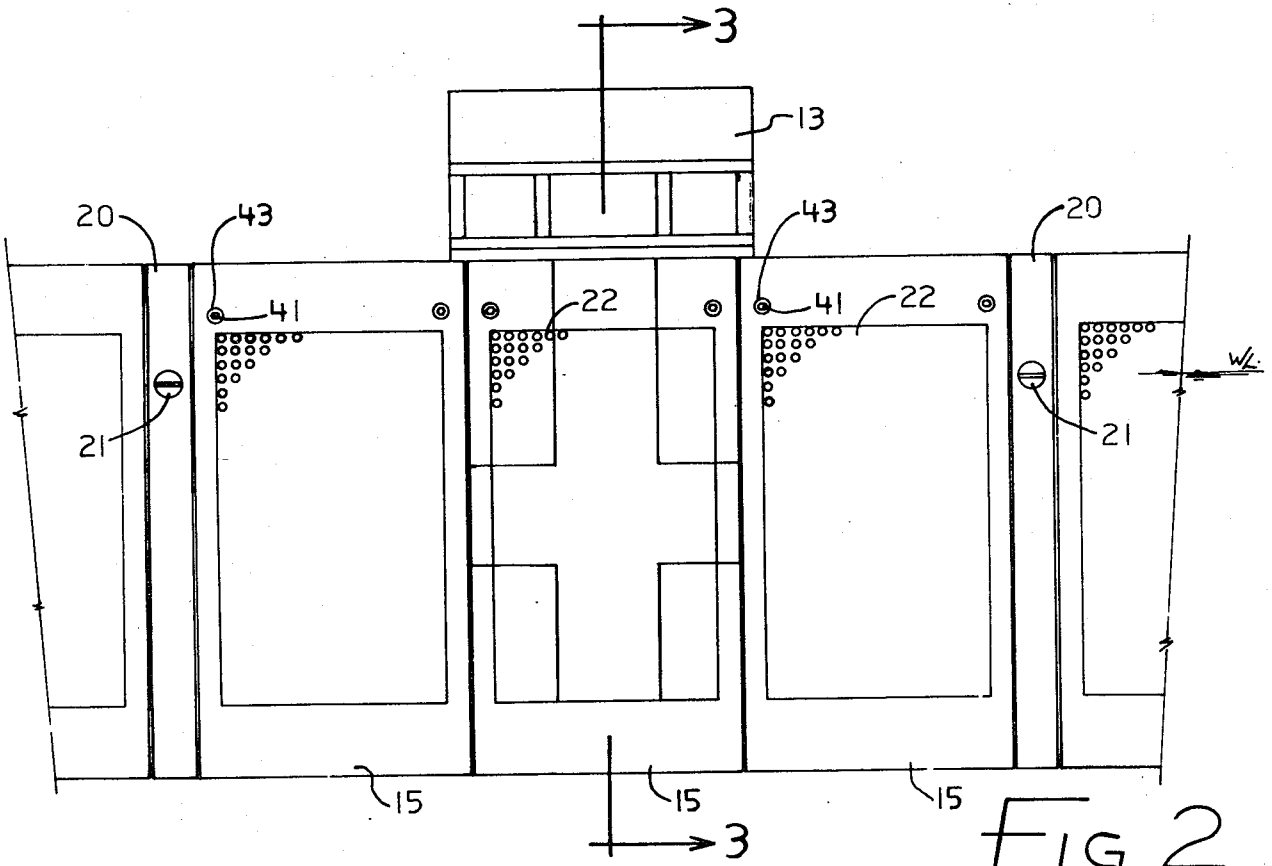
FIG. 2 is a partial elevational view of the vertical side of the bulkhead shown in FIG. 1.

As shown in FIG. 2, an intermediate vertical strip 20 is provided between the three panels 15 of each individual swimming lane. This strip 20 is fitted with a rope anchor 21 so that race lane floats may be stretched between bulkheads or between a bulkhead and the end of the pool to separate swimming lanes. The panels 15 are shown in FIG. 2 having a perforated area 22 to permit water to flow through the panels when the swimmer is approaching the bulkhead or when the bulkhead is being moved to another position in the swimming pool. Whereas the perforations are shown in the drawing as being round, these may be slotted or square in shape. In another embodiment the panels may be formed from a mesh screen. The term "perforations" includes any size or shape of apertures that allows water to pass through, but is not sufficiently large to normally permit a swimmer's fingers to enter.

Figure 3:
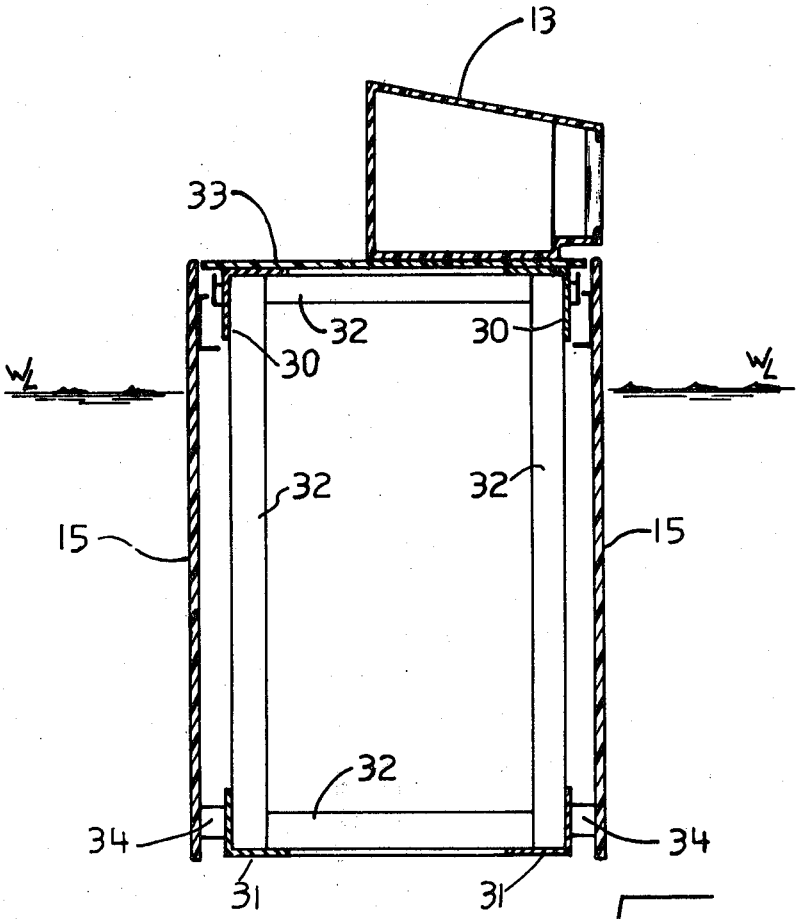
FIG. 3 is a cross sectional view at line 3—3 of the bulkhead shown in FIG. 2.

The construction of the bulkhead may be seen more clearly in FIG. 3. A rigid structural frame is formed of two top angles 30 and two bottom angles 31. Supporting and strengthening members 32, vertical, horizontal and diagonal are required to complete the construction of the frame. The vertical side panels 15 extend top to bottom of the frame to form the vertical contact surfaces of the bulkhead. Thus, when perforations 22 are provided in the panels 15, water flows easily through the bulkhead because there are no further obstructions. A walkway 33 extends across the two top angles 30 of the structural frame and supports the starting platforms 13. This walkway 33 provides a means for the swimmers and officials to reach the individual swimming lanes if the bulkhead is not at the end of the pool.

In the embodiment shown, the panels 15 are formed of a plastic material approximately one half inch thick and sufficiently rigid, such that no bending or distortion is caused by waves in the water. The panels 15 have vertical stiffeners (not shown) which extend down to within a short distance from where the panels are rigidly connected to the bottom angle 31 by a rigid spacer 34. Thus the panels flex in this short distance between the end of the stiffeners and the rigid connection. In another embodiment, the panel is formed of a metal plate, such as aluminum, and is sufficiently rigid not to require stiffeners. In such a panel the bottom connection is made sufficiently flexible to act as a hinge.

Figure 4:
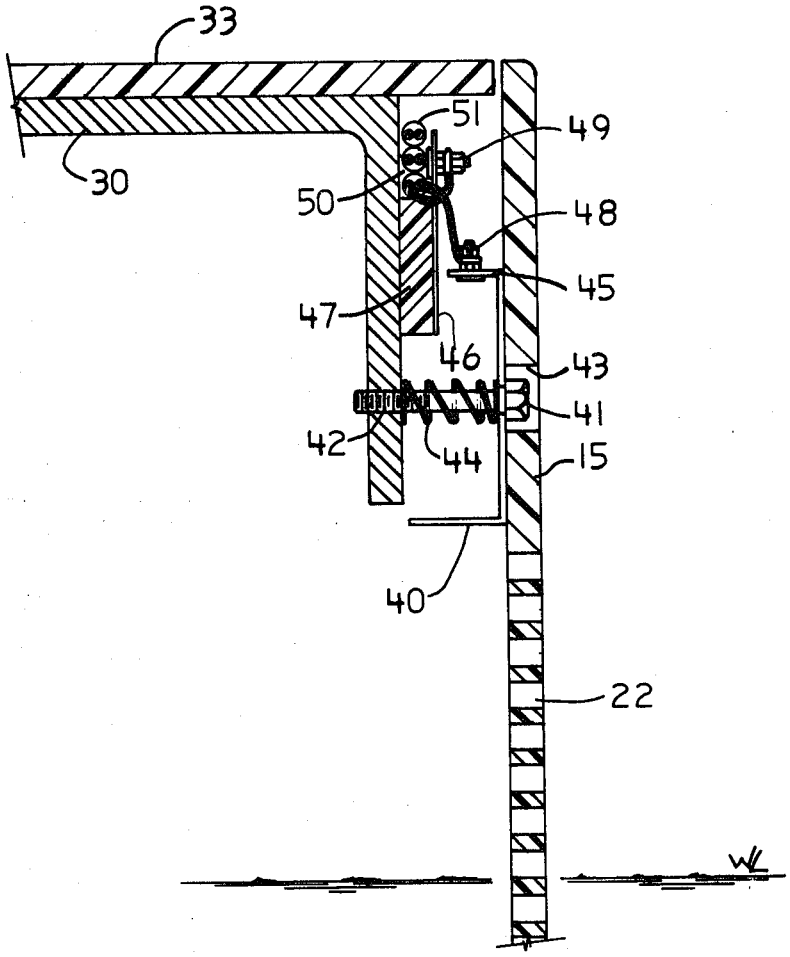
FIG. 4 is a partial sectional view of the top of one vertical side of the bulkhead showing one embodiment of the switch arrangement.

The switching arrangement which signals the arrival of a swimmer is seen in FIG. 4. A channel section 40 is firmly attached to the top of panel 15 above the perforations 22 and parallel to the top edge of the panel. Two bolts 41 pass through apertures in the channel 40 and guide and restrain movement of the panel 15 relative to the top angle 30. The bolts fit into tapped holes 42 and are positioned towards the side edges of each panel 15 as illustrated in FIG. 2. The heads of the bolts 41 are located in access apertures 43 in the panel 15. Rotation of the bolts 41 changes the distance between the top angle 30 and the panel 15. A spring 44 on each bolt 41 holds the panel 15 apart from the top angle 30. The top flange 45 of the channel 40 forms a contact which when the panel 15 moves in towards the angle 30 touches a contact plate 46 which is supported from the angle 30 by an insulating block 47. An electrical connector 48 is attached to the top flange 45 of the channel 40 and a further electrical connector 49 is attached to the top of the contact plate 46. The contact plate 46 extends upwards forming a conduit trough 50 for retaining wires or cables 51. The conduit trough 50 extends for the full length of the bulkhead, thus allowing cables 51 to be connected to the different switch mechanisms in each swimming lane. When three panels are used for one swimming lane as shown in FIGS. 1 and 2, the contact plate 46 extends for the width of the three panels 15, and jumper cables are used to join the top flanges 45 of channels 40 together, thus, if any one of the three panels 15 is contacted by a swimmer, springs 44 are compressed and contact is made between the top flange 45 and the contact plate 46 which opens or closes an electric circuit to activate the timing system. As may be seen in the configuration shown in FIG. 4 the contact switch arrangement is above the water level. A low voltage is used for the electric or electronic circuitry, so that if water does splash onto the terminals, short circuiting does not occur to close the circuit inadvertently.

In operation, the tension of the springs 44 is such so that a light pressure on the panel 15 is sufficient to deflect the panel and compress the springs 44 so the contact between the top flange 45 and contact plate 46 is made. The panel 15 may be contacted above water or below water, but is sufficiently resilient that it deflects to join the contacts. The combination of the springs 44 and the panel resiliency are sufficient to prevent wave pressure from approaching swimmers, closing the contacts until the panel is actually contacted by a swimmer.

The embodiment shown in the drawings provides for the panels 15 to be rigidly connected at their base to the bottom angles 31. It will be apparent to those skilled in the art, that one or more intermediate members may be located between the top and bottom angles 30,31 which may support the panels either rigidly or flexibly so that a light pressure on the panel activates the switching arrangement.

Figure 5:
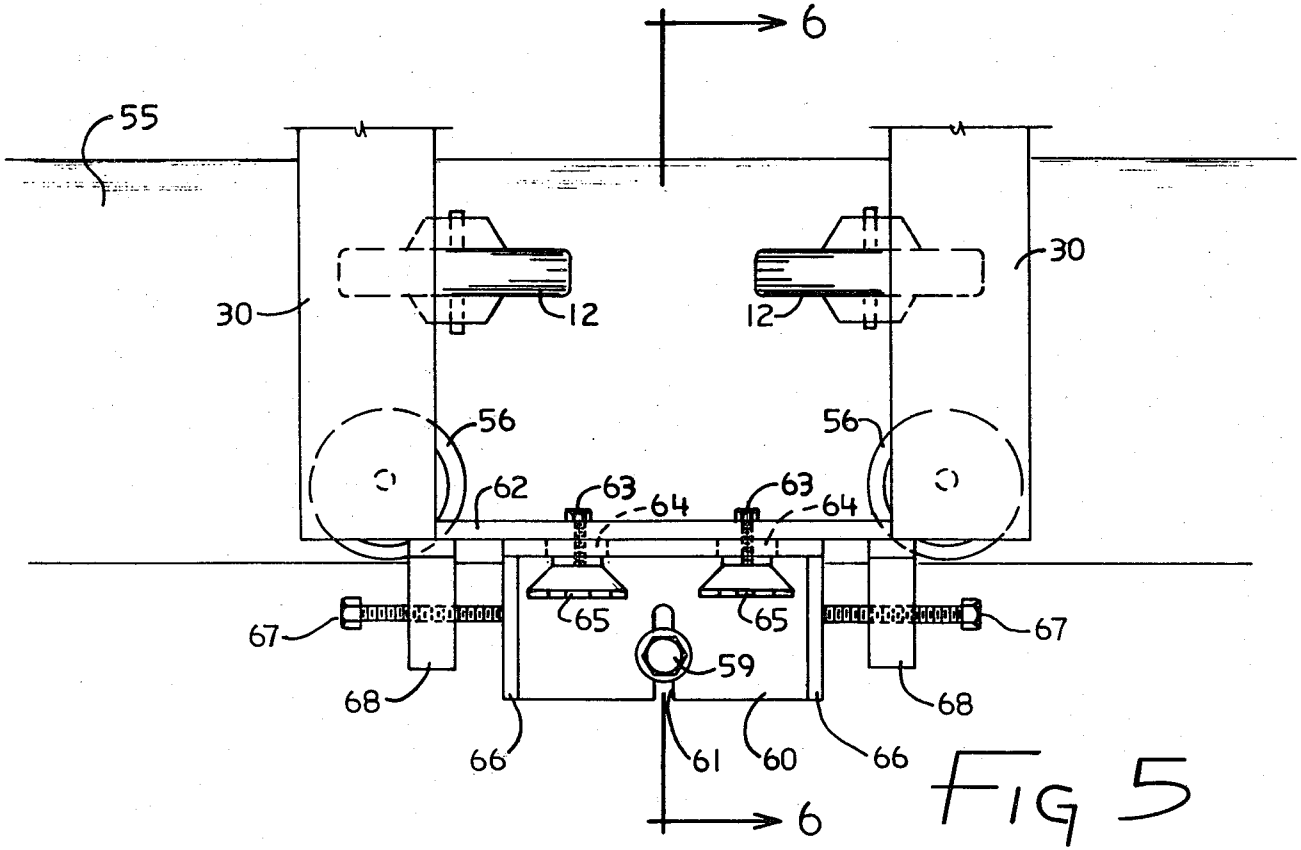
FIG. 5 is a top plan view of one end of the bulkhead showing the roller supports and the fine adjustment arrangement.
Figure 6:
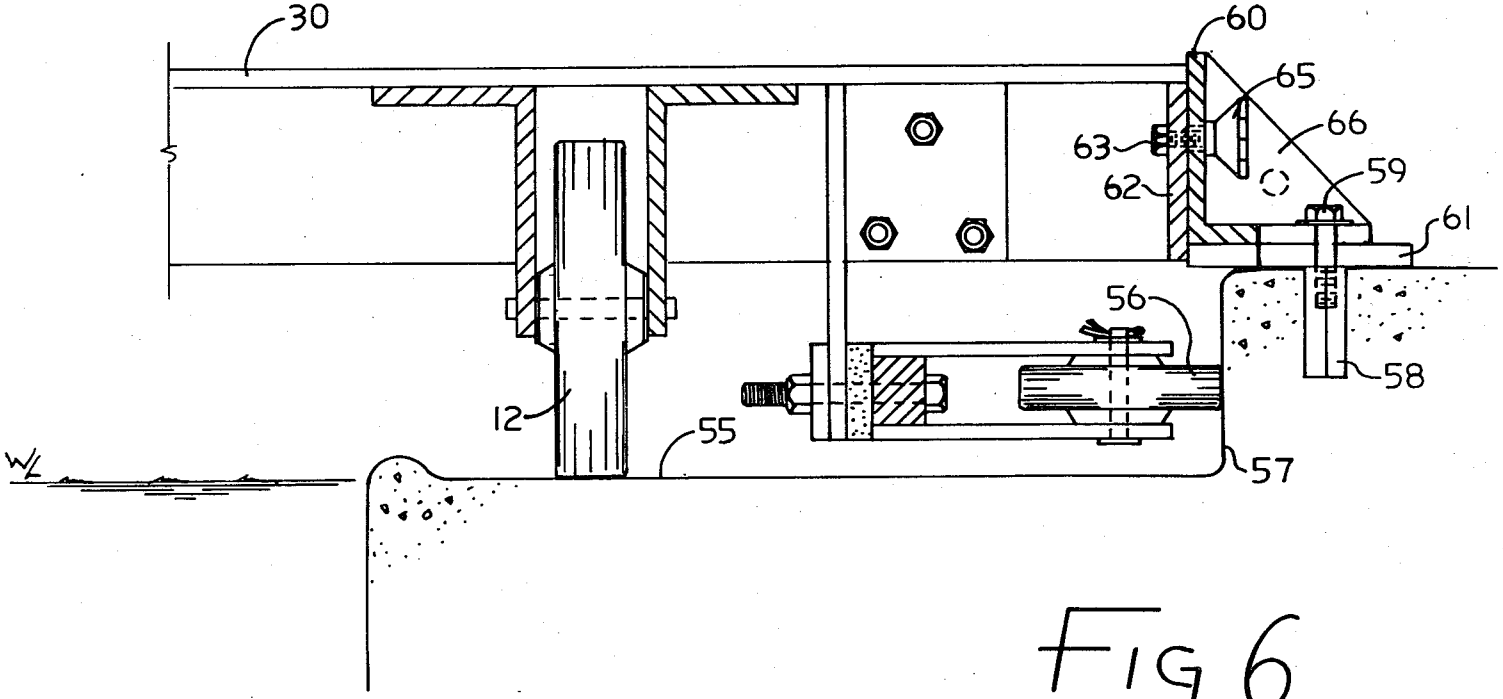
FIG. 6 is a cross sectional view at line 6—6 of the bulkhead shown in FIG. 5.

The ends of the bulkhead are shown in more detail in FIGS. 5 and 6 wherein the support rollers 12 rest on the gutter 55 of one particular type of swimming pool. It will be apparent that gutter and side wall configuration of swimming pools may vary from pool to pool, and therefore the arrangement of rollers 12 or alternate method of relocating the bulkhead may be changed depending on the pool and bulkhead configuration. Side rollers 56 are provided to rest against the vertical edge 57 of the gutter to act as guides for the bulkhead. A series of locating holes 58 are provided along the top edges of the swimming pool. These are tapped anchor holes, which hold a positioning bolt 59. A positioning angle 60, having a slot 61 in the horizontal flange to receive the positioning bolt 59, is held to the end plate 62 of the bulkhead by means of two bolts 63 which extend through horizontal slots 64 in the vertical flange of the angle 60. Special large knurled nuts 65 are provided to tighten onto the bolts 63 and firmly hold the angle 60 to the end plate 62 of the bulkhead. The angle 60 has gusset plates 66 at each end, and long bolts 67 extend through tabs 68 rigidly supported from the end plate 62 of the bulkhead. The tabs 68 have tapped holes therein so that by undoing one bolt 67 and doing up the other bolt 67 when the large knurled nuts 65 are loose, allows fine adjustment for positioning the bulkhead relative to the positioning bolt 59. This fine positioning feature is important when one wishes to accurately establish the distance between the vertical surfaces of bulkheads, or a bulkhead and the end of the pool for particular course lengths, such as 25 yards, 25 or 50 meters. No minus tolerances are allowed for course lengths, however, with the precise accuracy of the electronic timing devices which now record race times to one hundredth of a second, precise race distances are very desirable. The fine adjustment system allows each end of the bulkhead to be moved so that course lengths for all officially recognized swimming competitions can be realized and the lengths of the swimming lanes are as accurate as can be measured.

Because of the capability of electronic timing systems to time swimming races to one hundredth of a second (some have been designed to time to within one thousandth of a second) records can now be broken or established by beating previous records by one hundredth of a second. Therefore the capability of establishing the course length through the use of a bulkhead which effectively can bring the ends of the courses to within one or two millimeters of each other assures that the time of competitive events will be established in a legal length pool in which allowable length tolerances have been reduced to absolute practical minimum.

The structural frame of the bulkhead is preferably made out of aluminum sections for lightness, however, stainless steel fiberglass and other suitable synthetic materials may be used. The contact members behind the panels are preferably made from stainless steel to minimize attack from chemicals in the water. Whereas one embodiment of the mounting panel arrangement is illustrated in the specification, it will be apparent to those skilled in the art that other methods of construction may be used. Whereas three panels are shown per swimming lane, this may be increased or reduced. Regardless of the construction or number of panels, the important point is that the vertical contact surfaces always remain a part of the bulkhead and perform the double function of acting as the separating surface of the bulkhead and also as a swimmer arrival signal panel when used in swimming races or in training sessions.

The embodiments of the invention in which an exclusive property or privilege is claimed are defined as follows:

1. A movable swimming pool bulkhead comprising:

a rigid structure having top members and bottom members extending lengthwise along the bulkhead;

a walkway supported on the top members;

roller support means at each end of the bulkhead;

removable locating and anchoring means at each end of the bulkhead;

a vertical side face on at least one side of the bulkhead which acts to partition the swimming pool, the vertical side face extending between the top members and the bottom members and being divided into substantially equal portions to establish individual swimming lanes, the vertical side face including at least one integrally formed swimmer arrival panel extending between the top members and bottom members within each of the portions of the vertical side face representing individual swimming lanes;

means for mounting the integrally formed swimmer arrival panel to the rigid structure so as to be movable relative to the top members; and a switch means located between the rigid structure and the swimmer arrival panel for producing a signal when the swimmer arrival panel is pushed toward the top members as the panel is contacted by a swimmer.

2. The bulkhead according to claim 1 wherein the switch means is above the water level of the swimming pool.

3. The bulkhead according to claim 1 wherein three panels are provided within each swimmer lane on at least one side of the bulkhead.

4. The bulkhead according to claim 1 wherein each panel is rigidly connected at its base to the lower members of the rigid structure and the switch means is positioned between the top of the panel and the top member of the rigid structure such that the top of the panel is movable to actuate the switch means.

5. The bulkhead according to claim 4 wherein the switch means includes a contact plate and flange which make electrical contact with each other as the top of the panel is pushed towards the top members.

6. The bulkhead according to claim 4 wherein the means for mounting includes means for resiliently urging the top panel away from the top members.

7. The bulkhead according to claim 6 wherein the means for resiliently urging is adjustable to alter the amount of force which must be applied to the panel to cause the top of the panel to move relative to the top member causing actuation of the switch means.

8. The bulkhead according to claim 1 wherein the panel is perforated.

9. The bulkhead according to claim 1 wherein the removable locating and anchoring means includes a removable bolt adapted to locate each end of the bulkhead at predetermined positions and a fine adjustment means to provide limited movement of each end of the bulkhead from the predetermined positions.

10. The bulkhead according to claim 1 including a built-in wire cable trough.

11. The bulkhead according to claim 1 including starting platforms mounted on the walkway, one platform for each swimming lane, wherein each platform has two mounting positions, a first position for a swimmer to depart from one side of the bulkhead, and a second position for a swimmer to depart from the other side of the bulkhead.

* * * * *